United States Patent [19]

Voser

[11] 4,449,012

[45] May 15, 1984

[54] OVERHEAD CABLE WITH TENSION-BEARING MEANS

[75] Inventor: Othmar Voser, Möriken, Switzerland

[73] Assignee: Kupferdraht-Isolierwerk AG Wildegg, Wildegg, Switzerland

[21] Appl. No.: 330,961

[22] Filed: Dec. 15, 1981

[30] Foreign Application Priority Data

Dec. 19, 1980 [CH] Switzerland ..... 9374/80

[51] Int. Cl.[3] ..... H01B 7/08

[52] U.S. Cl. ..... 174/70 A; 174/113 C; 174/117 F; 174/131 A

[58] Field of Search ..... 174/70 A, 113 C, 117 F, 174/116, 131 A

[56] References Cited

U.S. PATENT DOCUMENTS

| | | | |
|---|---|---|---|
| 2,119,393 | 5/1938 | Lewis et al. | 174/116 |
| 2,463,590 | 3/1949 | Arutunoff | 174/113 C |
| 2,819,988 | 1/1958 | Smith . | |
| 3,540,203 | 11/1970 | Thoresen et al. | 174/70 A |
| 3,717,720 | 2/1973 | Snellman | 174/131 A |
| 3,857,996 | 12/1974 | Hansen et al. | 174/116 X |
| 4,039,743 | 2/1977 | Gommans | 174/113 C X |
| 4,084,065 | 4/1978 | Swenson | 174/131 A X |
| 4,097,686 | 6/1978 | Glandenbeck et al. | 174/131 A |
| 4,202,164 | 5/1980 | Simpson et al. | 57/232 |
| 4,319,074 | 3/1982 | Yaste et al. | 174/116 |

FOREIGN PATENT DOCUMENTS

| | | | |
|---|---|---|---|
| 1024228 | 7/1975 | Canada | 174/70 A |
| 12100 | 6/1980 | European Pat. Off. | 174/117 F |
| 2715585 | 10/1978 | Fed. Rep. of Germany | 174/117 F |
| 834955 | 12/1938 | France | 174/116 |
| 1366343 | 6/1964 | France | 174/117 F |

*Primary Examiner*—J. V. Truhe
*Assistant Examiner*—Morris H. Nimmo
*Attorney, Agent, or Firm*—William J. Daniel

[57] ABSTRACT

In known overhead telephone cables comprising two individual encased and stranded conductors, each consisting of a plurality of copper wires for the transmission of signals, and steel wires for load bearing purposes, the problem of relatively high susceptibility to corrosion at leakage points in the casing due to water penetration is solved by replacing the steel wires with bundles of stretch-resistant synthetic fibres, e.g. aromatic polyamide fibres, and the tendency of spirally wound synthetic fibres, or bundles of fibres, to shift towards the center of the conductor when the cable is under tension, and thus allow the cable to elongate is prevented by arranging the copper wires and bundles of fibres so that they position themselves mutually. The coherency of the bundles of fibres required for this purpose may be obtained, for example, by stranding or twisting the fibres in the bundle or impregnating the bundle with a resin, preferably colophony.

19 Claims, 6 Drawing Figures

OVERHEAD CABLE WITH TENSION-BEARING MEANS

The invention relates to an overhead cable comprising several conductors, each of which being surrounded by a protective cover and comprising a strand of a plurality of metal wires provided for signal transmission and of substantially unextensible load-bearing means extending essentially in longitudinal direction of the cable.

BACKGROUND OF THE INVENTION

Overhead cables of this kind, especially in the form of double-conductor cables, are used as telephone lines. In the past, telephone lines of this kind have been used in areas where telephone subscribers are located relatively far from a central exchange, or from the terminal of a subterranean telephone-cable system, and it would be too expensive to lay subterranean telephone lines running to these subscribers, because of the distance involved and the cost of providing a cable-tunnel for carrying only one or a few lines. In these known telephone cables for overhead lines, mainly steel wires have been used as the tension-bearing means, usually in the form of tinned copper wire and provided for signal transmission, constituting the individual conductors of the cable. In these known telephone lines, each of the two conductors had a polyethylene casing and an overlying polyamide casing, and were joined by means of an integral bridge made of the same polyamide between the two polyamide casings. These known telephone lines, however, have a major disadvantage, namely that the steel wires provided in the individual conductors as the tension-relieving means result in the conductors being substantially more liable to corrosion than conductors consisting exclusively of copper wires. For example, a series of failures of these mixed wire telephone lines was caused by leaks developing in the course of time in the polyethylene casing enclosing the conductors, for example at kinks or at locations of high mechanical alternating stress, and allowing water to penetrate into the conductors. This led eventually to failure of the conductors by corrosion at such locations. For the purpose of overcoming this disadvantage in known telephone lines, attempts were first made to reduce the corrodibility of the mixed wire conductors, to approximately that of conductors made exclusively of copper wire, by tinning not only the copper wires, but also the steel wires. Although this resulted in a certain decrease in the corrodibility of mixed wire conductors, the decrease was not down to the level of conductors made entirely of copper wires, because it was found impossible to produce, on the steel wire a coating of tin which would completely exclude water. The theoretical possibility of providing the steel and copper wires with completely impenetrable coatings of tin to achieve complete resistance to corrosion equal to that of tinned copper wires was in practice far from being achieved.

In other types of cables than, it is known to replace the tension-bearing steel wires within the conductors with fibres, or bundles of fibres, of high-strength non-metallic materials such as glass fibres, arranged within the cable-casing in the form of longitudinal reinforcing elements. The use of such non-metallic materials as tension-bearing mens naturally eliminates the problem of corrodibility arising with the use of steel wires. However, the arrangement used in known cables, namely to arrange within the cable casing the high-strength fibres in parallel with the axis of the cable and in the form of a layer of fibres, or of a bundle of fibres, distributed uniformly around the periphery of the conductor could not be transferred to overhead cables of the present type, since the fibre reinforcement of the cable-casing made the flexural strength or stiffness of the cable too high for overhead cables. The main reason for this is where the fibres in these known cables run parallel with the cable axis, any bending of the cable requires the fibres on the outside of the bend to stretch, but high-strength fibres resist this because of their resistance to elongation. Since overhead cables are subjected, at least in the vicinity of their suspension points, to relatively high and constantly alternating flexural stress, high flexural stiffness would very soon cause the fibres in areas of high flexural stress to break, thus eliminating the tension-bearing of the cable and leading sooner or later to complete breakage of the overhead cable, for example under conditions of very heavy loading, such as a storm. Now it is known, in the case of overhead telephone cables, that flexural stiffness and the consequences thereof, in the form of broken cables, caused by arranging the tension-relieving means in parallel with the axis of the cable, may be avoided by stranding the individual mixed wire conductors. The result of stranding, however, is that the overall length of the wires within the individual conductors, because of their spiral configuration due to stranding, is greater than the overhead cable itself, which means that the cable would be capable of undergoing elongation without actually stretching the wires, if it were possible for the wires to change from a spiral configuration to one coinciding with the axis of the cable. In the case of the overhead telephone cables, this is impossible because the wires enclosed within the individual casings position themselves mutually in each conductor, thus making impossible any displacement of the wires towards the axis of the cable under tensile loading. However, if in these overhead cables, the steel wires provided for tension-carrying effect were to be replaced simply by bundles of synthetic fibres running parallel with each other like cords, it would be quite possible for individual fibres in these bundles to shift towards the centre of the axis under tension, since the individual fibres in the bundles are not fixed within the conductor by the copper wires. This may be seen, for example in FIG. 1, if it is assumed that the unhatched circles are either steel wires or bundles of fibres consisting of individual fibres running parallel with each other, and that the hatched circles are copper wires. Where steel wires are used, the copper and steel wires position themselves mutually and this cannot be altered by loading the cable in tension; on the other hand, in the case of bundles consisting of individual fibres, the fibres in the three outer bundles can easily shift towards the centre. Initially all the six interstices grouped around the center bundle of fibres would be filled, whereupon the copper wires would be forced outwardly until the fibres in the outer bundles regroup themselves around the central bundle in generally layer fashion. Simultaneously with this regrouping, which would obviously take place only when the cable under tension, the cable would now lengthen in accordance with the now smaller average diameter of the spiral configuration of the three outer bundles of fibres, and the central bundles, which would be unable to lengthen and thus be subjected to the full tensile load and break, whereas the copper wires, of only relatively low tensile strength and thus capable of stretching, would stretch accordingly. Thus in spite of the exceptional resistance of the synthetic fibres to elongation under tension, the cable would stretch to the length attributable to the aforesaid regrouping. Therefore, the result of merely replacing the steel wires in the overhead cable of the type in question by bundles of synthetic fibres is the loss of stretch-resistance, and since resistance to stretching is one of the main requirements of an overhead cable, it is impossible, in the case of the known overhead cable, to replace the steel wires with high-strength synthetic fibres, and thus to overcome the corrosion problems mentioned hereinbefore, without taking special precautions.

SUMMARY OF THE INVENTION

It is the purpose of the invention to provide an overhead cable of the type in question which, on the one hand is free of corrosion problems such as arise in known overhead cables containing steel wires as the tension-bearing means and, on the other hand, has the same resistance to elongation and the same flexibility as known overhead cables using steel wires as the tension-bearing means.

According to the invention, this purpose is achieved with an overhead cable of the type in question wherein the load-bearing means are formed by one or more fibre bundles running in parallel to the metal wires and being stranded therewith and consisting of substantially unextensible artificial fibres, the individual fibre bundles being of such consistency and cross-sectional shape and being arranged within the conductors in such a manner that in the individual conductors, the fibre bundles and metal wires surrounded by the appertaining protectiver cover mutually fix each other in their respective positions thereby preventing any cable-extension-causing cross-shift of the stranded and therefore helically running fibres or fibre bundles towards the conductor axis under tensile load on the cable, so that each individual conductor and therefore also the whole cable is in spite of said helical run of the fibre bundles substantially unextensible.

The advantage of the present overhead cable, as compared with the known overhead cables of the type in question, is a substantially reduced susceptibility to corrosion. By completely impregnating the conductors with resin, the to corrosion resistance can even be reduced substantially below that achievable with known overhead cables consisting entirely of tinned copper wire (which are not themselves feasible because of insufficient resistance to elongation). Another advantage of the present overhead cable, as compared with the said known overhead cables, is a reduced weight per unit length. The weight of the bundles of fibres replacing the steel wires as the tension-bearing means, for the same strength properties, is substantially less than that of steel wires, with the result that the weight per unit of length of the present overhead cable is between 20 and 40% less than that of known overhead cables. This weight advantage is of considerable significance, since the tension in the cable arises mainly from its own weight.

In one preferred example of embodiment of the present overhead cable, the cross-sectional shape of each bundle of fibres is substantially circular. In order to achieve adequate coherency and a substantially unvarying circular cross-sectional shape, even when the cable is under tension, each bundle of fibres in this example of embodiment is preferably stranded per se, and the bundles may consist of single-stranded or multiple-stranded synthetic fibres. In the interests of consistency or uniformity and unchangeable cross-sectional shape under tensile load, however, it is better for the bundles of fibres to consist of double-stranded or twisted synthetic fibres.

In the case of another, also highly advantageous design of the present overhead cable, the cross-sectional shape of each bundle of fibres is such that the part of the interior enclosed by the conductor and not occupied by the metal wires, i.e., the interstices therein is completely filled by the fibre bundle.

In the present overhead cable, it is desirable for each bundle of fibres and/or each conductor to be resin-impregnated in its entirety, in order to achieve adequate or enhanced consistency, substantially unchanging cross-sectional shape of the bundles of fibres or conductors, even when the cable is under tension or uniformity. From the point of view of consistency of individual bundles of fibres, this resin-impregnation is not necessary per se where each bundle of fibres is stranded per se. However, such resin-impregnation increases the consistency of individual bundles of fibres still further. Moreover, impregnation of the whole conductor has the advantage of keeping any water which may penetrate the conductors away from the metal wires. On the other hand, resin-impregnation, for the purpose of achieving adequate consistency, would also appear to be indicated if the individual bundles of fibres consist of synthetic fibres arranged parallel with each other in the manner of cords. This parallel cord-like arrangement of synthetic fibres in the individual bundles of fibres is particularly appropriate for the above-mentioned alternative design of the present overhead cable, because in this design the cross-sectional shapes of the individual bundles of fibres are usually not circular, and it is therefore impossible for the individual bundles of fibres to be stranded per se. The resin used for impregnation is preferably one which breaks down into a powder when loaded in compression and/or bending beyond its breaking limit. The advantage of this is that if the overhead cable is overloaded in bending at any point, the flexural rigidity of the cable will be reduced by the breakdown of the resin into powder to such an extent as to prevent the cable or individual conductors from breaking due to to excessive flexural rigidity. Impregnation with a resin of this kind is particularly useful if the conductors are completely resin-impregnated or if bundles of fibres of relatively large cross-section are used. It is desirable for the resin used for impregnation to consist completely, or at least for the majorpart, of natural resin, preferably colophony.

In the present overhead cable, the synthetic fibres constituting the bundles of fibres are preferably made of a synthetic material, more particularly an organic polymer. With special advantage it may be an aromatic polyamide. It is desirable for the synthetic fibres to have a tensile strength of at least 250 kg/mm$^2$, a modulus of elasticity of at least 10000 kg/mm$^2$, and an elongation at rupture of less than 3%. The said fibres may, however, consist wholly or partly of glass fibres, preference being given to so-called high-strength glass fibres.

In the present overhead cable, the metal wires in each conductor may with advantage be arranged in central symmetry with the axis of that conductor. With particular advantage, however, each conductor may be provided with a central metal wire, the axis of which coincides with the conductor axis, and with three outer metal wires of the same diameter as the central metal wire, the outer wires being arranged at angular distances of 120° around the central metal wire and bearing or bordering against the latter. With this arrangement of metal wires, it is desirable for each conductor to be provided either with three bundles of fibres of circular cross-section and of at least approximately the same diameter as the metal wires, and arranged between the three outer metal wires and also bearing or bordering against the central metal wire, or with three bundles of fibres of approximately trapezoidal cross-section, each of which completely fills one of the three cavities defined by two, i.e., an adjacent pair, of the outer metal wires, the central metal wire, and the inner wall of the casing which, in this case, should be internally cylindrical with a diameter three times that of the metal wires. In the first case, the bundles of fibres of circular cross-section are preferably stranded per se, whereas in the last case the bundles of fibres of trapezoidal cross-section preferably consist of synthetic fibres arranged parallel with each other like cords and resin-impregnated. Another advantageous possibility for the centrally-symmetrical arrangement of the metal wires is to provide each conductor with three metal wires of the same diameter, the axes of which are spaced from the conductor axis a distance equal to one and half times their diameter, and which are arranged around the conductor axis at angular intervals of 120° . In this case it is desirable to provide each conductor with a central bundle of stretch-resistance fibres of circular cross-section and of the same diameter as the metal wires, the axis of which coincides with the conductor axis, and with three outer bundles of fibres, also of circular cross-section and of the same diameter as the metal wires, which are arranged between the three metal wires and or border bear against the central bundle of fibres; in this case, the individual bundles of fibres are also preferably stranded per se.

Another advantageous possibility of the centrally symmetrical arrangement of metal wires is to provide each conductor with a central bundle of fibres, axially coinciding with the conductor axis, and with a plurality of metal wires arranged around the central bundle of fibres and or bordering bearing against it and against each other.

In the present overhead cable, the metal wires of the conductor are preferably made of copper and are preferably tinned. The use of tinned copper wire makes it possible to obtain a cable with unusually small liability to corrosion. The copper wires may also be coated with other corrosion-resistant coatings instead of tin, for example multiple lacquer coatings.

In the present overhead cable, the inside of the casing of each conductor should preferably engage in depressions or recesses present on the outside of the conductor and should fill them substantially completely. This may very easily be achieved by applying the cable casing to the cable, or to the individual conductors, by extrusion under pressure. The material used for the cable casing is preferably a waterproof, and more particularly a water-repelling, polyamide. The casings of individual conductors in the cable are preferably made integral with each other by bridges between them. These bridges may be produced simultaneously with the extrusion of the cable casing, by a suitable design of extruder and suitable guidance of individual cable-conductors through the said extruder.

The invention also relates to the use of the present overhead cable as a telephone laid in the open air. Preference is given in this connection to double-conductor overhead cables according to the present invention.

BRIEF DESCRIPTION OF THE DRAWING

The invention is explained hereinafter in greater detail in conjunction with the examples of embodiment illustrated in the drawing attached hereto, wherein.

DETAILED DESCRIPTION OF PREFERRED EMBODIMENTS

Figures 1, 2, 3, 4, 5, 6:
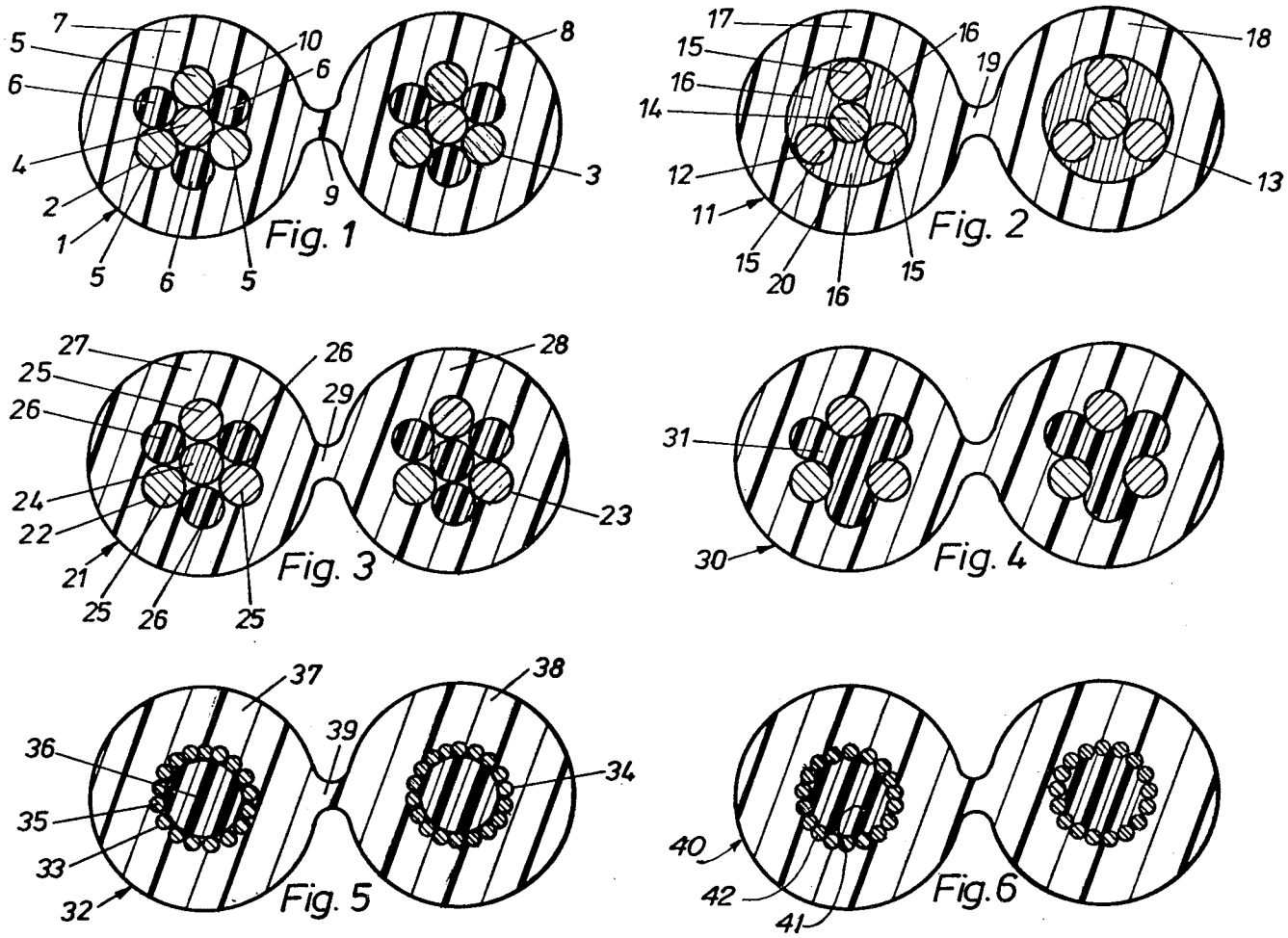
FIG. 1 shows a cross-section of one embodiment of the present overhead cable with two conductors each having four copper wires and three bundles of fibres stranded per se.
FIG. 2 shows a cross-section of another embodiment of the present overhead cable with two conductors each having four copper wires and three bundles of fibres in the form of synthetic fibres, arranged in parallel with each other like cords.
FIG. 3 shows a cross-section of an embodiment of the present overhead cable with two conductors each having three copper wires and four bundles of fibres stranded per se.
FIG. 4 shows a cross-section of another embodiment of the present overhead cable with two conductors each having three copper wires and one bundle of fibres consisting of synthetic fibres, arranged in parallel with each other like cords.
FIG. 5 shows a cross-section of an embodiment of the present overhead cable with two conductors each having sixteen copper wires and a bundle of fibres stranded per se.
FIG. 6 shows a cross section of another embodiment of the present overhead cable with two conductors each having sixteen copper wires and a bundles of fibres in the form of synthetic fibres, arranged in parallel with each other like cords.

In the double-conductor overhead cable illustrated in FIG. 1, for use as a telephone line, conductors 2 and 3 each consist of four tinned copper wires 4,5 of equal diameter and of three bundles of fibres 6 of circular cross-section and of the same diameter as the copper wires, one copper wire 4 being arranged centrally and the three remaining copper wires 5, together with the bundles of fibres 6, being arranged in alternating sequence around the central copper wire. Each bundle of fibres 6 consists of a plurality of strands each comprising a plurality of synthetic fibres stranded per se and then stranded with each other, i.e., of twisted synthetic fibres. The synthetic fibres are made of aromatic polyamide having a tensile strength of 300 kg/mm$^2$, a modulus of elasticity of 13400 kg/mm$^2$, an elongation at rupture of 2.6%, and a specific gravity of 1.45 g/cm$^3$. Synthetic fibres of this kind are known from the bulletin "Kevlar 49, Technical Information, Bulletin No. K-1, June 1974" of the Dupont de Nemours Company, page 3, paragraph A and table I and are generally known in practice as aramide fibres. Conductors 2,3 are spirally stranded per se with a lay-length or pitch equal to between 10 and 15 times the diameter of the conductor or between 30 and 45 times the diameter of copper wires 4,5. Each of the two conductors 2,3 is provided with a casing 7,8 for simultaneous electrical insulation and mechanical protection against weathering and corrosion, the two casings forming, with an integral connecting bridge 9, the casing of overhead cable 1. This cable casing consists of a waterproof, and preferably also water-repelling, polyamide and is applied to previously stranded conductors 2,3 by extrusion under pressure. This method of application causes the insides of casings 7,8 to engage in depressions 10 in the outsides of conductors 2,3 and to fill them substantially completely.

Tests of the overhead cable shown in FIG. 1 have shown that, as compared with a known telephone-line cable of similar dimensions, with the same cable casings 7, 8,9, using tinned steel wires instead of tinned copper wires 4,5, and using tinned copper wires instead of bundles of fibres 6, the weight of the present cable was 16.4% lower, the direct-current resistance per unit of length was 8.1% lower, the tensile strength was 3.8% higher, and corrosion resistance was substantially improved, as was the frequency response within the speech-frequency range. For example, attenuation in the known telephone-line cable increased over the frequency in the speech-frequency range substantially more sharply than in the cable illustrated in cable 1, which would appear to be attributable to the steel wires used in the known cable. Furthermore, the flexural rigidity of the cable illustrated in FIG. 1 was substantially lower than in the known telephone-line cable, which considerably reduces the danger of cable or conductor breakage in the vicinity of the cable suspension points. Only in resistance to elongation were the values obtained with the cable shown in FIG. 1 slightly lower than those obtainable with the known telephone cable over a range of temperature fluctuations of between −30° and +40° C. This result, however, is not attributable to the material of the synthetic fibres, which has a resistance to elongation even better than steel. It is more likely to be because, in the cable illustrated in FIG. 1, bundles of fibre 6 consist of twisted synthetic fibres, and because the resistance to elongation of such "twisted fibres" attains the resistance to elongation of the fibre material only under very high preload. Although it would not be difficult to achieve correspondingly high preloads in bundles of fibre 6 during the manufacture of the cable, such high preloads are undesirable because they would have a detrimental effect upon the flexural rigidity of the cable; the substantially improved flexural rigidity of the present cable, as compared with the known telephone-line cable, is much more important than the slight increase in resistance to expansion obtainable with increased preloading of the bundles of fibres.

The overhead cable shown in cross-section in FIG. 2 is of substantially similar construction as the cable in FIG. 1, i.e. it also comprises two conductors 12,13 and four tinned copper wires 14,15, three bundles of fibres 16 and one casing 17,18 per conductor. There is also a bridge 19 between the casings and the arrangement of copper wires 14,15 and bundles of fibres 16, in relation to each other, corresponds substantially to that in FIG. 1. In this case, however, the bundles of fibres are made, not of twisted fibres, but of fibres arranged in parallel with each other like cords and are impregnated with colophony. Moreover, in this case the bundles of fibre are not of circular but of approximately trapezoidal cross-section and inner walls 20 of casings 17,18 are not shaped as in FIG. 1, but are cylindrical instead. In spite of the very similar construction, the cable shown in FIG. 2 has technical properties which differ substantially from those of the cable in FIG. 1. For instance, the tensile strength of the cable in FIG. 2, for the same external dimensions and thickness of copper wire as in the cable in FIG. 1, is almost twice that of the cable in FIG. 1, because of the larger cross-sections of the bundles of fibres, and because the fibres in the bundles are arranged in parallel with each other like cords, thus providing a larger effective cross-section area per unit of area of the bundles of fibres. Moreover, the flexural rigidity of the cable in FIG. 2, mainly because of the resin-impregnation of the bundles of fibres, is substantially greater that that of the cable in FIG. 1. However, this increased flexural rigidity does not increase the dange of cable or conductor breakage, since the colophony used for resin impregnation has the property of breaking down into a powder when subjected to overloading and this sharply reduces flexural rigidity in the overloaded areas. Furthermore, the resistance of the cable in FIG. 2 to elongation is somewhat greater than that of the cable in FIG. 1, mainly because of the parallel arrangement of the fibres in the bundles. It even exceeds the resistance to elongation of the known telephone-line cable mentioned in connection with the explanation of FIG. 1. On the whole, therefore, the mechanical properties of the cable in FIG. 2. are still better than those of the cable in FIG. 1 and substantially better than those of the corresponding known telephone-line cable. As regards electrical properties such as ohmic resistance and frequency response, and also in the matter of weight per unit of length, the cable in FIG. 2 is fully equal to the cable in FIG. 1.

Overhead cable 21 shown in cross-section in FIG. 3 corresponds almost completely to the cable illustrated in FIG. 1, except that central copper wire 4 in FIG. 1 is replaced in the cable in FIG. 3 by a central bundle of fibres 24, the construction of which is identical with that of the bundles of fibres 6 in FIG. 1. Apart from this, conductors 22,23, with externally tinned copper wires 25, external bundles of fibres 26, casings 27,28 and bridge 29, are identical in construction and dimensions with the corresponding parts of the cable illustrated in FIG. 1. Although as compared with the telephone-line cable mentioned in connection with the explanation of FIG. 1, the cable in FIG. 3 has an ohmic resistance which is 23.7% higher, it has a lower increase in arttenuation over the frequency, like the cable in FIG. 1, so that attenuation in the speech-frequency range in the case of the cable in FIG. 3 is only slightly above the attenuation in this known telephone-line cable. In contrast to this, the tensile strength of the cable in FIG. 3 is almost 40% higher, and the weight per unit of length is about 25% lower, than in the known telephone-line cable. As regards flexural rigidity and resistance to elongation, the cable in FIG. 3 has paractically the same properties as the cable in FIG. 1. Thus, on the whole, the mechanical properties of the cable in FIG. 3 are substantially better than those of the known telephone-line cable, since its higher tensile strength, in conjunction with its lower weight and substantially lower flexural rigidity, mean that it can withstand substantially higher loads than the known telephone cable, for example the transmission towers holding the cable may be twice as far apart. Thus, of the cables shown in FIGS. 1 and 3, that in FIG. 3 should be used if the line is to be subjected to high mechanical stresses, whereas the cable in FIG. 1 is to be preferred when the overall length of the cable is relatively great and the main interest is therefore minimal attenuation per unit of length of the cable.

Overhead cable 30, shown in cross-section in FIG. 4 is of substantially similar design to the cable illustrated in FIG. 3, except that the four separate bundles of fibres 24, 26 are replaced by a common bundle of fibres 31, the cross-sectional shape of which corresponds substantially to that of all four bundles of fibres together. Furthermore the fibres in this bundle are not twisted like the fibres in bundles 24, 26 in the cable according to FIG. 3, nut are arranged in parallel with each other like cords. Furthermore, the bundle of fibres in the cable in FIG. 4 is impregnated with colophony, which is not the case with bundles 24,26 of the cable in FIG. 3. The properties of the cable in FIG. 4 differ from those of the cable in FIG. 3 in that the tensile strength is between 20 and 30% higher, the resistance to elongation is slightly higher, and the flexural rigidity is substantially higher. In view of this high flexural rigidity, the cable in FIG. 4 is more suitable for use in areas where the main interest is in high tensile strength and flexural rigidity, and the ability to withstand alternating loads are less important, since, although in the cable in FIG. 4, the colophony breaks down into powder at locations where the cable is overloaded, the strength properties at such locations are somewhat lower than in corresponding locations in the cable in FIG. 2.

Overhead cables 32 and 40, shown in cross-section in FIGS. 5 and 6, have conductors 33,34, the design of which differs in principle from that of the cables in FIGS. 1 to 4. However, the design and dimensions of the cable casing is substantially similar to the cables in FIGS. 1 to 4. In the cables in FIGS. 5 and 6, several individual bundles of fibres 6,16; 24,26 appearing in FIGS. 1 to 3 are combined to form a single, substantially circular, centrally arranged bundle of fibres 36,41 of approximately the same cross-section as the collective cross-section of the individual bundles of fibres. Moreover the central bundle of fibres is surrounded by a layer of tinned copper wires of smaller diameter than copper wires 4,5; 14,15; 25 in the cables in FIGS. 1 to 4, the overall copper cross-section corresponding to that of the cables in FIGS. 1 and 2. As compared with the cables in FIGS. 1 and 2, the diameter of copper wires 35 is about half as large and there are four times as many wires. In conductors 33,34, the lay-length corresponds approximately to that of the cables in FIGS. 1 to 4. As with the cables in FIGS. 1 to 4, conductors 33,34 are provided with casings 37,38 joined together by a bridge 39. In cable 32, shown in FIG. 5, central bundle of fibres 36 consists of twisted fibres, while bundle of fibres 41 in the cable shown in FIG. 6 are arranged in parallel with each other like cords, and are impregnated with colophony. The material of the fibres is as in the cables in FIGS. 1 to 4. As regards technical properties, cable 32 in FIG. 5 corresponds to the cable in FIG. 1, except that flexural rigidity is slightly less, because the three bundles of fibres in the cable in FIG. 1 are combined to form a single bundle 36 which is arranged centrally. As compared with cable 32 in FIG. 5, cable 40 in FIG. 6 has a tensile strength about 25 to 35% higher, because of the parallel arrangement of the fibres and, because of the resin impregnation, slightly increased resistance to elongation and substantially greater flexural rigidity but, as in the case of the cable in FIG. 2, this does not increase the danger of cable or conductor breakage. In all other properties, cable 40 in FIG. 60 is substantially equal to cable 32 in FIG. 5.

In conclusion, it should be pointed out that the definitions used herein for the arrangement of fibres, and for the arrangement of metal wires and bundles of fibres in relation to each other, more particularly the expression "arranged in parallel with each other like cords" used repeatedly in connection with the arrangement of fibres, and the expression "running parallel with the metal wires" used in connection with the arrangement of bundles of wires in relation to metal wires, the stranding of the conductors, since otherwise those definitions would have become too involved. These definitions therefore apply to sections of cable of relatively short length in comparison with the lay-length of the conductor stranding.

I claim:

1. An overhead cable comprises at least two conductors each comprising a plurality of metal wires for signal transmission and a plurality of substantially non-extensible load-bearing substantially circular helically stranded fiber bundles, both said wires and bundles extending generally in the longitudinal direction of the cable and being helically stranded together, and an exterior protective cover enclosing said wires and bundles, and a bridge connecting together the covers of each adjacent pair of conductors in said cable, said conductor having one metal wire or fibre bundle at the center thereof as a core, said plural metal wires and said circular fibre bundles other than said core being arranged generally symmetrically around the core axis at substantially equispaced peripheral points therearound with said wires and bundles in alternating relation, said symmetrically arranged wires being of like size and said symmetrically arranged bundles being of like size, each such bundle being in abutting contact with said core and the adjacent pair of wires.

2. An overhead cable according to claim 1 wherein each fibre bundle consists of single-stranded synthetic fibres.

3. An overhead cable according to claim 1 wherein each fibre bundle consists of multiple-stranded synthetic fibres.

4. An overhead cable according to claim 3 wherein each fibre bundle consists of double-stranded or twisted synthetic fibres.

5. An overhead cable according to claim 1 wherein each fibre bundle and/or each conductor in its entirety is resin-impregnated.

6. An overhead cable according to claim 5 wherein the resin of said resin-impregnation is a resin breaking down into a powder when subjected to compression and/or bending stress exceeding its ultimate strength for such stress.

7. An overhead cable according to claim 6 wherein the resin is completely or at least for its major part natural resin.

8. An overhead cable according to claim 7 wherein the natural resin is colophony.

9. An overhead cable according to claim 1 wherein the artificial fibres consist of a synthetic material.

10. An overhead cable according to claim 9 wherein the synthetic material is an organic polymer.

11. An overhead cable according to claim 10 wherein the organic polymer is an aromatic polyamide.

12. An overhead cable according to claim 11 wherein the fibres have a tensile strength of at least 250 $kg/mm^2$, a modulus of elasticity of at least 10,000 $kg/mm^2$, and an elongation at rupture of less than 3%.

13. An overhead cable according to claim 1 wherein each conductor comprises a core metal wire and three outer metal wires of the same diameter as the core metal wire, the axis of the central metal wire coinciding with the axis of the respective conductor and the three outer metal wires being arranged in angular distances of 120° around the central metal wire and abutting on the core metal wire.

14. An overhead cable according to claim 13 wherein each conductor comprises three fibre bundles of a substantially circular cross-sectional shape and of at least approximately the same diameter as the metal wires, each of said three fibre bundles being arranged between two of the three outer metal wires and abutting also on the core metal wire.

15. An overhead cable according to claim 1 wherein each conductor comprises three metal wires of equal diameter, the axes of which are spaced a distance from the axis of the respective conductor being equal to the total of one-half the diameter of said core and one-half the diameter of one of said metal wires, said metal wires being arranged in angular distances of 120° around the center axis of the conductor.

16. An overhead cable according to claim 15 wherein each conductor comprises a core fibre bundle and three outer fibre bundles, each of these four fibre bundles having at least approximately the same diameter as the metal wires, each of said three outer fibre bundles being arranged between two of the three metal wires and abutting the core fibre bundle.

17. An overhead cable according to one of the claim 1 wherein the metal wires consist of copper.

18. An overhead cable according to claim 17 wherein the copper wires are tinned.

19. An overhead cable according to claim 1 wherein each stranded conductor having peripheral indentations therein and the protective cover therefor engages in said peripheral indentations and substantially fills them.

* * * * *